United States Patent [19]

Doncel

[11] Patent Number: 4,806,943

[45] Date of Patent: Feb. 21, 1989

[54] SET OF TRANSMIT/RECEIVE ANTENNAS SITUATED AT A FIXED STATION FOR A TWO-WAY RADIO LINK WITH A VEHICLE

[75] Inventor: Miguel Doncel, Evry, France

[73] Assignee: Companie Generale d'Automatisme, Paris, France

[21] Appl. No.: 124,523

[22] Filed: Nov. 24, 1987

[30] Foreign Application Priority Data

Nov. 25, 1986 [FR] France ..... 86 16397

[51] Int. Cl.[4] ..... H01Q 11/12

[52] U.S. Cl. ..... 343/742; 343/717; 343/866; 343/867

[58] Field of Search ..... 343/742, 711, 713, 717, 343/866, 867, 873; 455/99, 129, 272, 274; 340/941

[56] References Cited

U.S. PATENT DOCUMENTS

| | | | |
|---|---|---|---|
| 1,612,427 | 12/1926 | Flurscheim | 343/713 |
| 2,157,532 | 5/1939 | Foster | 343/711 |
| 2,597,518 | 5/1952 | Parks | 343/867 |
| 3,182,314 | 5/1965 | Kleist | 343/6.5 |
| 3,694,751 | 9/1972 | Takahashi | 325/51 |
| 3,742,150 | 6/1973 | Sherman et al. | 179/82 |
| 4,239,415 | 12/1980 | Blikken | 404/75 |

FOREIGN PATENT DOCUMENTS

| | | | |
|---|---|---|---|
| 0938376 | 9/1948 | France | 340/941 |
| 0021683 | 9/1969 | Japan | 343/742 |
| 2034558 | 6/1980 | United Kingdom . | |

*Primary Examiner*—William L. Sikes
*Assistant Examiner*—Hoanganh Le
*Attorney, Agent, or Firm*—Sughrue, Mion, Zinn, Macpeak & Seas

[57] ABSTRACT

In a fixed station for a two-way radio link with a vehicle (5) which has a self-contained transmit/receive device (6) including a transmit antenna (8) in the form of a vertical axis coil so as to generate a vertical electromagnetic field and a receive antenna (9) in the form of a horizontal axis coil disposed transversely relative to the vehicle, a set of transmit/receive antennas at the fixed station includes a receive antenna constituted by a first multiconductor cable (10) forming a rectangular loop whose long dimension runs parallel to the direction of vehicle displacement, and a transmit antenna constituted by a second multiconductor cable (12) forming two narrow elongate rectangular loops extending in the direction of vehicle displacement and mutually parallel so as to create a horizontal electromagnetic field extending perpendicularly to the direction of vehicle displacement. The first and second cables are placed in slots (11) formed in the roadway where the vehicle passes, and subsequently closed by suitable material (18). The ends (13, 14, 15, and 16) of the two cables are brought together to the side of the roadway (1) in a junction box (17) for enabling various connections to be performed, the junction box also receiving two screened cables, one of which serves to feed the transmit antenna, and the other of which serves to receive current picked up by the receive antenna.

1 Claim, 3 Drawing Sheets

SET OF TRANSMIT/RECEIVE ANTENNAS SITUATED AT A FIXED STATION FOR A TWO-WAY RADIO LINK WITH A VEHICLE

The present invention relates to a set of transmit/-receive antennas situated at a fixed station for a two-way radio link with a vehicle.

BACKGROUND OF THE INVENTION

The invention applies, in particular, to transmitting information between a moving vehicle and fixed electronic equipment. A typical application is constituted, for example, by automatic free passage into a closed area subjected to access authorization: e.g. a gate leading to the premises of an organization, a gate for subscribers on a toll road, etc.

In this type of application, transmission must be ensured under good conditions between a miniaturized transmitter/receiver of very low power on board a vehicle and equipment situated in fixed premises.

The frequencies used lie in the range 50 kHz to 150 kHz. It is thus known to make use of a frame whose dimensions are about 1 meter (m) as the antenna system for the fixed equipment for transmission to the on-board equipment, and a winding on a ferrite core for reception from the on-board equipment. The assembly is placed on a platform next to the path where the vehicle must pass through a kind of tunnel.

However, such a system is bulky and gets in the way of any pedestrian traffic, it is not protected against possible accidents, and the electromagnetic coupling between this antenna system and the antenna system on the moving equipment is poor so that the distance between the vehicle and the platform-mounted antenna system must be very small.

The aim of the present invention is to mitigate these drawbacks.

SUMMARY OF THE INVENTION

The present invention provides a set of transmit/-receive antennas situated at a fixed station for a two-way radio link with a vehicle, said vehicle being provided with a self-contained transmitter/receiver device fixed to the bottom of the vehicle and including a transmit antenna in the form of a vertical axis coil so as to generate a vertical electromagnetic field and a receive antenna in the form of a horizontal axis coil disposed transversely relative to the vehicle, wherein the set of transmit/receive antennas at the fixed station comprise a receive antenna constituted by a first multiconductor cable forming a rectangular loop whose long dimension runs parallel to the direction of vehicle displacement, and a transmit antenna constituted by a second multiconductor cable forming two narrow elongate rectangular loops extending in the direction of vehicle displacement and mutually parallel so as to create a horizontal electromagnetic field extending perpendicularly to the direction of vehicle displacement, said first and second cables being placed in slots formed in the roadway where the vehicle passes, and subsequently closed; the ends of the two cables being brought together to the side of the roadway in a junction box for enabling various connections to be performed, said junction box also receiving two screened cables, one of which serves to feed the transmit antenna, and the other of which serves to receive current picked up by the receive antenna.

BRIEF DESCRIPTION OF THE DRAWING

An embodiment of the invention is described by way of example with reference to the accompanying drawings, in which.

MORE DETAILED DESCRIPTION

Figure 1:
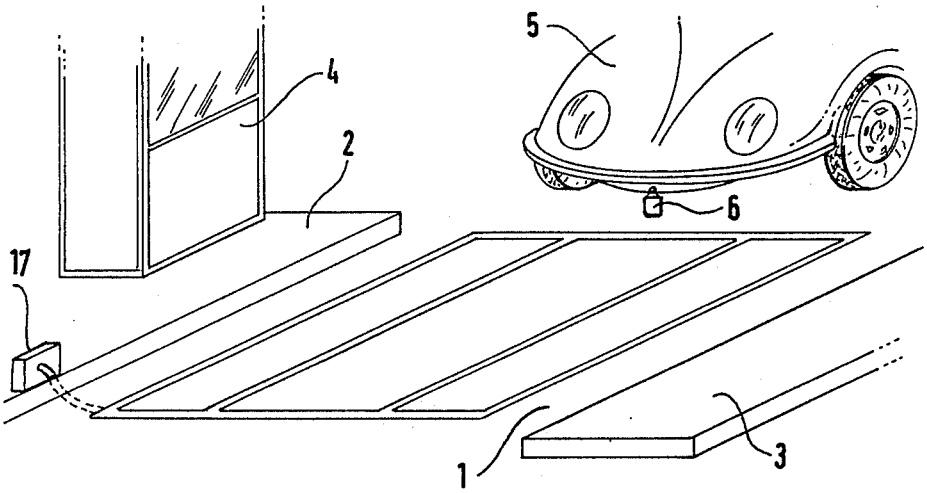
FIG. 1 is an overall view of an installation including a set of antennas in accordance with the invention.

With reference to FIG. 1, it can be seen that a general installation comprises a set of antennas in accordance with the invention. For example, the figure shows a gate under surveillance and leading to enclosed premises, such as those of a company.

The inwards path 1 is delimited on its sides by two platforms or sidewalks 2 and 3.

Figure 2:
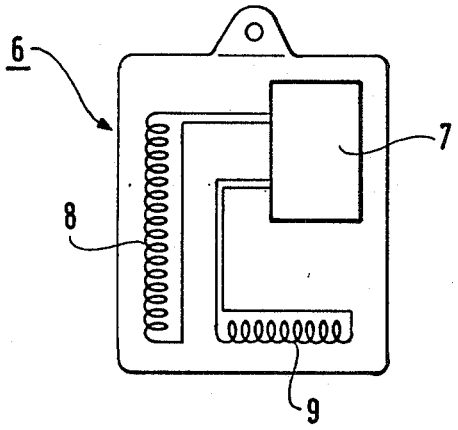
FIG. 2 is a diagram showing a self-contained transmitter/receiver device fixed on the vehicle.

A surveillance and control station 4 is disposed on platform 2 and serves to collect and process information received from passing vehicles, such as car 5. The car is fitted with a small pendant 6 constituting a self-contained transmitter/receiver device and hanging, for example, from the front bumper. The pendant 6 is waterproof on the outside and made of plastic. FIG. 2 is a diagram of the inside of the pendant which comprises a miniature transmitter/receiver together with its power supply represented overall by a block referenced 7, together with two antennas: a transmit antenna 8 constituted by a coil on a ferrite rod having a vertical axis so as to generate a vertical electromagnetic field; and a receive antenna 9 constituted by a coil on a ferrite rod whose axis is horizontal and disposed transversely relative to the car 5.

In the example described, a vehicle is to be identified in order to authorize access, for example by automatically opening a gate in the event that the vehicle is recognized. In this particular case, the transmitter/-receiver 7 of the pendant 6 is normally in a standby state and it is activated only on receiving a signal which is permanently transmitted by the transmit antenna of the fixed station.

Figure 3:
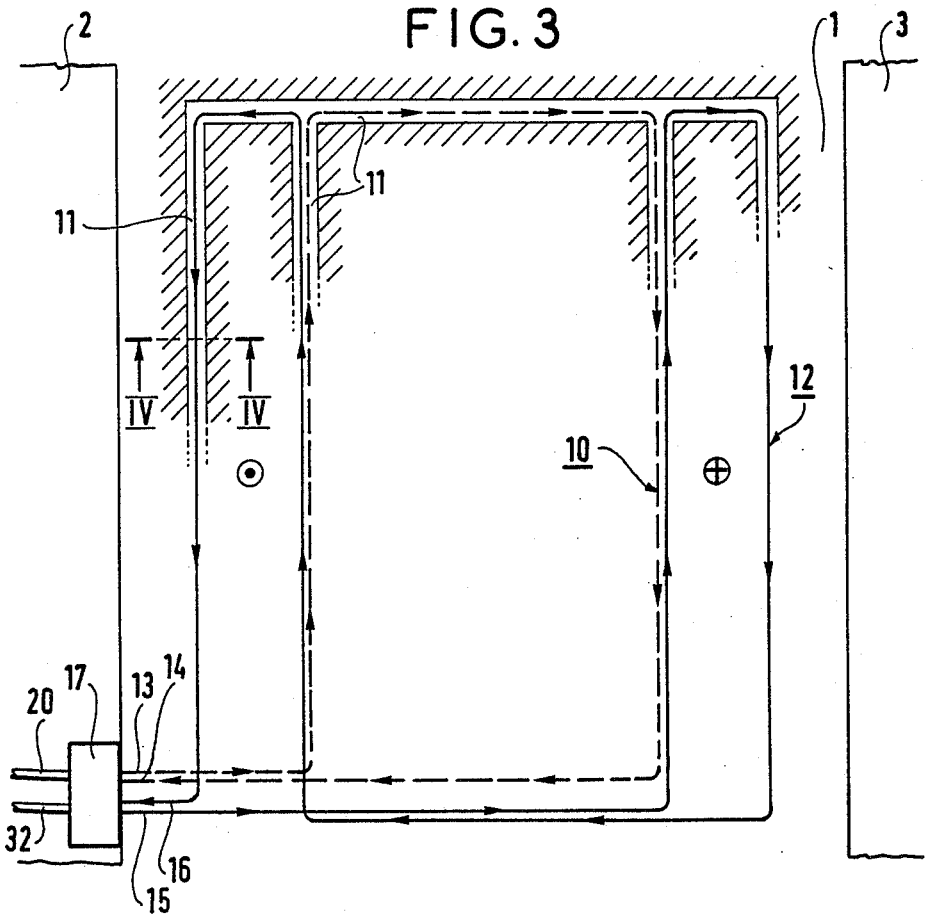
FIG. 3 shows how the set of transmit/receive antennas in accordance with the invention is implanted and disposed.

Reference is now made to FIG. 3 showing the disposition in the ground of the roadway of two antennas, one for transmitting and the other for receiving. The receive antenna is constituted by a multiconductor cable 10 shown in dashed lines in FIG. 3 and installed in slots 11 in the roadway to constitute a rectangular loop whose larger dimension is parallel to the direction of vehicle displacement, as can be seen in the figure. This antenna receives the vertical electromagnetic field transmitted by the antenna 8 of the pendant 6 on the car 5.

The transmit antenna is likewise constituted by a multiconductor cable 12 installed in slots 11. This transmit antenna, as can clearly be seen in FIG. 3, forms two narrow elongate and mutually parallel rectangular loops. These two loops are oppositely handed, thereby "closing" the field so as to generate an electromagnetic field which is horizontal and perpendicular to the direction of vehicle movement. Thus, since the two fields transmitted by the transmit antenna 8 in the pendant 6 and by the transmit antenna 12 in the ground are mutually orthogonal, there is no risk of interference between the two transmissions. For example, the selected frequencies are 132 kHz for transmission by the ground equipment and 66 kHz for transmission by the moving equipment.

The ends 13 and 14 of the receive antenna cable 10 and the ends 15 and 16 of the transmit antenna cable 12 are brought together on the side of the road in a junction box 17 where connections can be made thereto.

Figure 4:
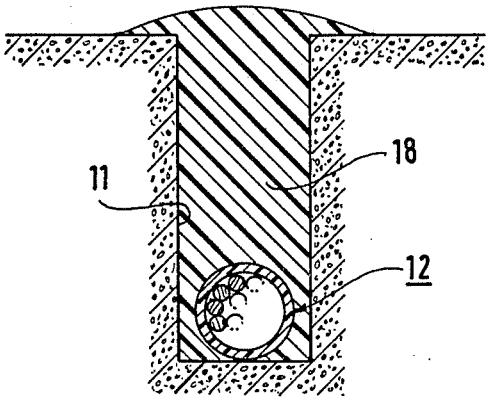
FIG. 4 is a section of IV—IV of FIG. 3 showing a slot in the roadway.

Once the set of antennas has been put into place in the slots 11 in the roadway, the slots are filled in with a plastic filler 18 as can be seen in FIG. 4.

The length of the rectangular antenna loops 10 and 12 in the direction of vehicle movement is chosen as a function of the time required to transmit messages and of the approximate average speed of the vehicles as they go through the installation, which speed should in any case be slow.

Figure 5:
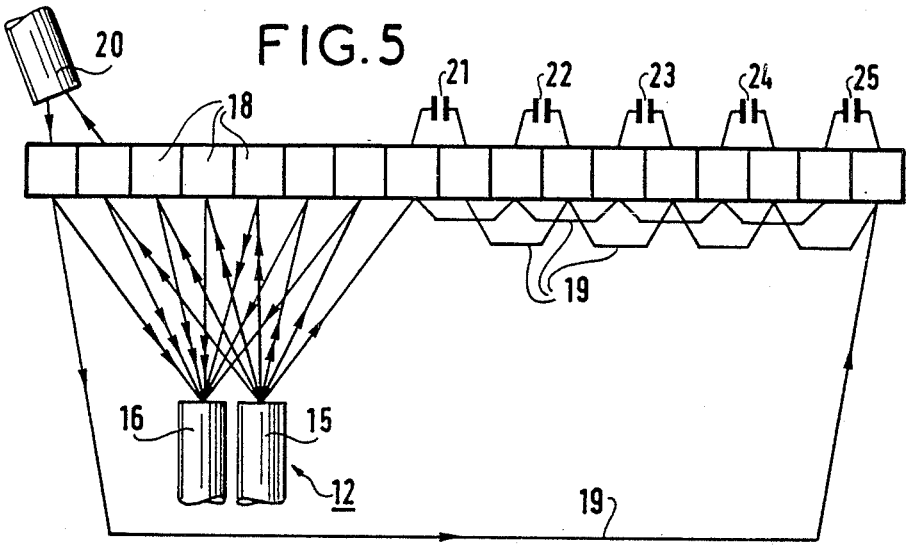
FIG. 5 is a diagram showing the connection system of the transmit antenna.
Figure 6:
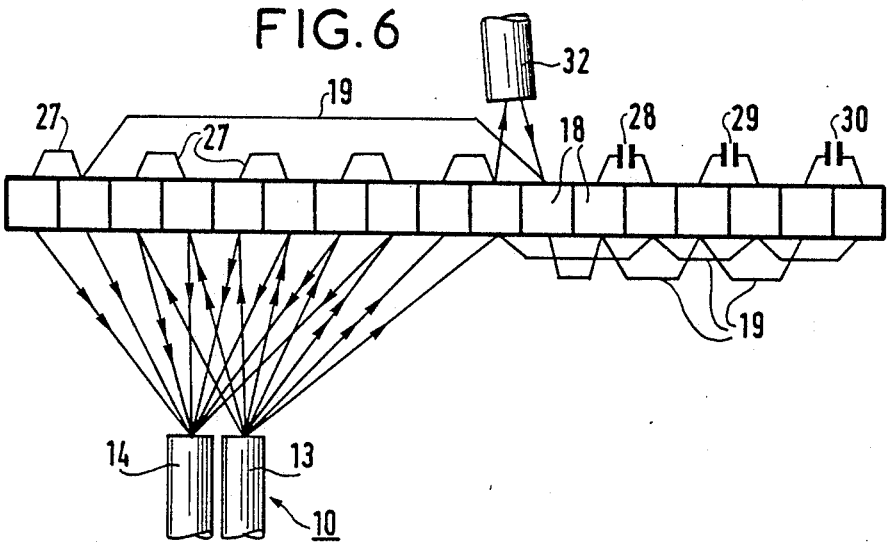
FIG. 6 is a diagram showing the connection system of the receive antenna.

The use of multiconductor cables 10 and 12 considerably reduces the amount of installation required in the roadway slots and provides great flexibility in antenna matching: the number of turns is variable; impedances can be matched. In the example described, each of the cables 10 and 12 comprises a dozen isolated conductors, and FIGS. 5 and 6 are diagrams respectively showing the transmit antenna 12 and the receive antenna 10 and showing the connections provided in the housing 17. These connections are made by means of a terminal strip having a plurality of mutually isolated terminals 18 and cooperating with electrical links 19 and 27.

Figure 7:
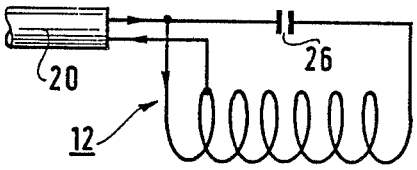
FIG. 7 shows the electrical equivalent circuit of the wiring provided for the transmit antenna as shown in FIG. 5.

In both of these FIGS. 5 and 6, arrows are marked on the conductors of the antenna cables 10 and 12 whose ends 13 & 14 15 & 16 are shown. A double arrow indicates that two conductors are connected in parallel. This makes it possible to use all 12 conductors even when 12 turns are not required. In FIG. 5, it can be seen that the wiring of the transmit antenna, which corresponds to the equivalent circuit of Figure 7, is constituted by seven full turns of the cable 12.

The transmit antenna 12 is also powered by a feed cable constituted by a screened twisted pair 20. Capacitors 21, 22, 23, 24, and 25 equivalent to the single capacitor 26 shown in the equivalent circuit of FIG. 7 completes the circuit for the purpose of antenna tuning.

Figure 8:
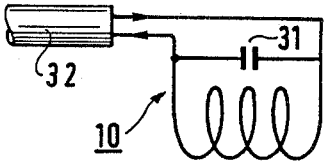
FIG. 8 shows the electrical equivalent circuit of the wiring performed for the receive antenna as shown in FIG. 6.

In FIG. 6, which corresponds to the wiring of the receive antenna 10 whose equivalent circuit is given in FIG. 8, it can be seen that four full turns of the cable 10 are used.

To do this, the conductors are taken in groups of three, with the connections 27 performing this grouping. The antenna circuit is adjusted by means of three capacitors 28, 29, and 30 which correspond to the single capacitor 31 shown in FIG. 8, which capacitors are connected in parallel on the antenna 10. The current picked up by the receive antenna 10 is conveyed by a cable constituted by a screened twisted pair 32.

Thus, the set of antennas at a fixed station in accordance with the invention does not take up any room in that it is embedded in the roadway and thus provides no obstacle to pedestrians. In addition, the assembly is completely protected from the risk of possible accidents, bad weather, fire, etc. No maintenance is required.

Since the antenna is centered on the road, transmission conditions are good. In general, a set of antennas in accordance with the invention is also, in general, cheaper than the above-mentioned prior art set.

As can be seen in FIG. 3, the receive antenna 10 is received in the inner slots used for placing the inside branches of the two rectangles of the transmit antenna loop. Naturally, it would also have been possible to place it in the outer slots or even to use special slots therefore. Naturally it is simpler to make use of common slots.

Naturally, the above-described antenna system may be used in numerous applications: toll gateways giving subscribers access to motorways, gates into enclosures under surveillance, regulated parking areas, paying parking areas,

I claim:

1. A set of transmit/receive antennas situated at a fixed station for a two-way radio link with a vehicle, said vehicle being provided with a self-contained transmitter/receiver device fixed to the bottom of the vehicle and including a transmit antenna in the form of a vertical axis coil so as to generate a vertical electromagnetic field and a receive antenna in the form of a horizontal axis coil disposed transversely relative to the vehicle, wherein the set of transmit/receive antennas at the fixed station comprises a receive antenna constituted by a first cable comprising a first plurality of conductors and a rectangular loop whose long dimension runs parallel to the direction of vehicle displacement, and a transmit antenna constituted by a second cable comprising a second plurality of conductors and forming two narrow elongate rectangular loops parallel to each other and extending in the direction of vehicle displacement so as to create a horizontal electromagnetic field extending perpendicularly to the direction of vehicle displacement, said first and second cables being placed in slots formed in the roadway where the vehicle passes, and subsequently closed; the ends of the two cables being brought together to the side of the roadway in a junction box for enabling various connections to be performed, said junction box also receiving two screened cables, one of which serves to feed the transmit antenna, and the other of which serves to receive current picked up by the receive antenna.

* * * * *